US005409663A

United States Patent [19]

Taylor et al.

[11] Patent Number: 5,409,663

[45] Date of Patent: Apr. 25, 1995

[54] TARNISH RESISTANT GOLD COLORED ALLOY

[76] Inventors: Arthur D. Taylor, 115 Park St., Buffalo, N.Y. 14201; Norman J. LaMontagne, Jr., 31 Watuppa Rd., Westport, Mass. 02790; Malcolm Warren, 1228 Main Rd., Corfu, N.Y. 14036

[21] Appl. No.: 237,314

[22] Filed: May 3, 1994

Related U.S. Application Data

[63] Continuation of Ser. No. 64,261, May 19, 1993, abandoned.

[51] Int. Cl.[6] ..... C22C 30/02

[52] U.S. Cl. ..... 420/587; 148/419; 148/442

[58] Field of Search ..... 420/587, 582; 148/538, 148/442, 419

[56] References Cited

U.S. PATENT DOCUMENTS

| | | | |
|---|---|---|---|
| 4,370,164 | 1/1983 | Harris et al. | 420/503 |
| 4,539,176 | 9/1985 | Cascone | 420/463 |
| 4,557,895 | 12/1985 | Karamon et al. | 420/587 |
| 4,804,517 | 2/1989 | Schaffer et al. | 420/587 |
| 4,865,809 | 9/1989 | Davitz | 420/580 |
| 4,895,701 | 1/1990 | Davitz | 420/587 |
| 4,948,557 | 8/1990 | Davitz | 420/503 |
| 4,992,297 | 2/1991 | van der Zel | 427/2 |

FOREIGN PATENT DOCUMENTS 60-56047 4/1985 Japan .

OTHER PUBLICATIONS

Agarwal and Raykhtsaum, "Color Technology for Jewelry Alloy Applications", *The Santa Fe Symposium on Jewelry Manufacturing Technology* 1988, pp. 229–243. (no month avail.).

Raykhtsaum and Agarwal, "Tarnish Behavior of Low Karat Jewelry Alloys–Quantitive Analysis", *The Santa Fe Symposium on Jewelry Manufacturing Technology* 1989, pp. 115–129 (no month avail.).

*Primary Examiner*—Upendra Roy
*Assistant Examiner*—Sean Vincent
*Attorney, Agent, or Firm*—Fish & Richardson

[57] ABSTRACT

An indium-free, gold-colored, tarnish and corrosion-resistant alloy having no greater than 10% by weight gold and a color value, as measured according to the Cielab Color Measurement System, of approximately L=87.4, a=1.1, b=15.3. The alloy comprises 28–35% copper, 19.5–22.5% silver, 6–11% palladium, 22–32% zinc, 0.1–1% aluminum, and 0.5–3% platinum.

12 Claims, No Drawings

TARNISH RESISTANT GOLD COLORED ALLOY

This is a continuation of application Ser. No. 08/064,261, filed May 19, 1993, now abandoned.

BACKGROUND OF THE INVENTION

The present invention is directed to metal alloys for use in jewelry, especially for use in the fabrication of relatively high weight academic rings and corporate recognition jewelry products.

The customary jewelry alloys having a gold content between 41 and 75 weight percent are well suited for the production of jewelry. Alloy compositions such as these are resistant to corrosion, investment cast easily and have an esthetic yellow color.

In more recent times, because of the high price of gold, alloys have been developed for ring casting that contain lower gold weight percentages than the traditional 10K, 14K and 18K. Additions of indium and palladium in various ratios along with increased weight percentages of silver have been widely employed to increase corrosion resistance in dental formulations as well as jewelry alloys. Davitz U.S. Pat. No. 4,895,701 discloses a corrosion resistant gold-free dental compositions resembling 10K that contain about 18% copper, 25% palladium, 21% indium and the balance being silver. In this case the resulting yellow color is reportedly due to a reaction of copper and indium in the presence of palladium. Van Der Zel U.S. Pat. No. 4,992,297 teaches that combinations of palladium and indium can produce yellow colors through the formation of the brittle intermetallic compound B-PDIN and that in an alloy consisting of approximately equal ratios of palladium, indium and silver, the addition of gold up to 10% increases the hardness and has the adverse effect of reducing the yellow color.

More common are alloys for dental and jewelry applications that contain 15 to 40 weight percent gold along with lesser additions of palladium, indium, copper, zinc and, for the enhancement of specific metallurgical properties, trace elements. Several U.S. patents describe gold colored alloys for use in dentistry and jewelry with and without copper and zinc but compositions with less than 11% by weight gold contain indium. Generally, as the by weight percentage of gold decreases, the indium weight percent increases.

Since indium bearing alloys are often subject to irreversible chemical changes under melting conditions very similar to normal operating parameters, cost advantages of using a lower gold quality material for ring casting can be lost due to poor quality castings and excessive proportions of unusable scrap. Normally, the intrinsic value of indium is significantly higher than silver, but because of complications in chemical refining, indium is often ignored or lost into waste while silver, gold and platinum group metals are effectively recovered. Further, indium presents a number of worker health concerns when melted in poorly ventilated areas. What is desired is a low gold, corrosion resistant yellow alloy which avoids disadvantages described in the prior art.

SUMMARY OF THE INVENTION

In general, the invention features an indium-free, gold-colored, tarnish and corrosion-resistant alloy having no greater than 10% by weight gold and a color value, as measured according to the Cielab Color Measurement System, of about L=87.4, a=1.1, b=15.3.

In preferred embodiments, the alloy has a melting temperature of 1590° F.±50° and a casting temperature between 1650° to 1750° F.

Preferred alloys include, in addition to gold, copper (28 to 35% by weight, preferably 30 to 33%), silver (19.5 to 22.5% by weight, preferably 20 to 22%), palladium (6 to 11% by weight, preferably 6 to 8%), zinc (22 to 32% by weight, preferably 24 to 26%), platinum (0.5 to 3% by weight, preferably 0.5 to 1.5%) and aluminum (0.1 to 1% by weight, preferably 0.2 to 1.0%). The amount of gold is preferably 6 to 8% by weight.

The alloy may also include one or more fluidizing agents to decrease the viscosity of the melt. The preferred fluidizing agent is boron in an amount of 0.01 to 0.1% by weight, preferably 0.01 to 0.02%.

The alloy may also include one or more deoxidants. Preferred deoxidants include silicon (0.1 to 1% by weight, preferably 0.1 to 0.3%) and boron (0.01 to 0.1% by weight, preferably 0.01 to 0.02%). The boron also acts as a fluidizing agent. Phosphorus may also be included as a deoxidant (0.001 to 0.1% by weight).

The alloy may also include nickel (5 to 8% by weight, preferably 5 to 7% by weight) to control the grain size of the material.

The invention also features an article of jewelry formed of the above-described alloy compositions.

The invention provides an indium-free, corrosion-resistant, low gold alloy suitable for jewelry investment casting.

Other features and advantages of the invention will be apparent from the following description of a presently preferred embodiment, and from the claims.

DESCRIPTION OF THE PREFERRED EMBODIMENT(S)

As previously described, the alloy of the invention preferably contains no indium and only 6–8% by weight gold. Contrary to formulations in the prior art, in the present composition the yellow color originates from the copper, gold, silver and zinc mixture and not from an interaction of palladium and indium. Thus, the color may be adjusted to meet special criteria by variation of any or all of the four mentioned elements. Furthermore, the prior art teaches that in low gold, indium-bearing alloys, the shade of yellow color due to the palladium-/indium interaction is subject to change should the targeted ratio of these two elements vary. Since indium is likely to be lost from the cast rings though volatilization and/or oxidization during typical investment casting melting operations, the consistency of product color is at risk from uncontrolled changes in the elemental composition. Thus, a further advantage of the present invention is the consistency of color in case rings through metal composition stability.

The additions of platinum, palladium and aluminum increase the otherwise limited corrosion resistance of the basic gold, silver, copper and zinc formulation.

Nickel is added to reduce the average grain size so as to make the material more malleable and thus more useful for jewelry fabrication processes.

Silicon and boron are added at trace levels to deoxidize the melt and decrease the viscosity of the molten material in order to permit casting of higher resolution.

A preferred alloy will consist of 7,000% by weight gold, 25,482% by weight zinc, 21,700% by weight silver, 31.155% by weight copper, 5.998% by weight nickel, 0.465% by weight aluminum, 0.186% by weight silicon, 0.014% by weight boron, 7.000% by weight palladium and 1,000% by weight platinum.

TABLE

| | Example No.: | | |
|---|---|---|---|
| | 1 COMPOSITION | 2 GOLD WITH INDIUM | 3 10K |
| METAL | | | |
| Au | 7.00 | 7.00 | 41.67 |
| Ag | 25.48 | 56.00 | 12.11 |
| Cu | 31.16 | 11.61 | 39.51 |
| Pd | 7.00 | 9.00 | 0.00 |
| Zn | 21.70 | 0.50 | 6.40 |
| Ni | 5.99 | 0.00 | 0.00 |
| Al | 0.47 | 0.00 | 0.00 |
| Pt | 1.00 | 0.00 | 0.00 |
| Si | 0.19 | 0.00 | 0.17 |
| B | 0.02 | 0.02 | 0.00 |
| COLOR | LIGHT YELLOW | LIGHT YELLOW | YELLOW |
| PERSPIRATION RESISTANCE | SLIGHT DARKENING; WHITE DEPOSIT | MODERATE DARKENING; WHITE DEPOSIT | SLIGHT DARKENING |
| HYDROGEN SULFIDE | BLACKENING CONSIDERABLE | BLACKENING CONSIDERABLE | BLACKENING SLIGHT |
| HUMIDITY | | | |
| 7 DAYS | NO EFFECT | NO EFFECT | NO EFFECT |
| 14 DAYS | NO EFFECT | SLIGHT DARKENING | SLIGHT DARKENING |
| 21 DAYS | NO CHANGE | NO CHANGE | NO CHANGE |

The alloy compositions of the invention show greater resistance to artificial perspiration than the indium-bearing, low gold formulation tested and slightly less tolerance than the 10K. As would be expected by those familiar with the art, both low gold formulations showed less resistance to an atmosphere containing hydrogen sulfide than did the more noble 10K. Surprisingly, the invention composition example showed more resistance to long term exposure to a humid atmosphere than did the indium-bearing material and the traditional 10K.

It is therefore apparent that the alloy system of the present invention accomplishes its objects. While the invention is described in detail, this is for the purpose of illustration, not limitation.

Other embodiments are within the following claims.

What is claimed is:

1. An indium-free, gold-colored, tarnish and corrosion-resistant alloy comprising no greater than 10% by weight gold, wherein said alloy further comprises by weight 28% to 35% copper, 19.5% to 22.5% silver, 6% to 11% palladium, 22% to 32% zinc, 0.1% to 1% aluminum, and 0.5% to 3% platinum, said alloy having a color value, as measured according to the Cielab Color Measurement System, of approximately L=87.4, a=1.1, and b=15.3.

2. The alloy of claim 1, said alloy having a melting temperature of 1590° F.±50°.

3. The alloy of claim 1, said alloy having a casting temperature between 1650° to 1750° F.

4. The alloy of claim 1, wherein said alloy further comprises a fluidizing agent.

5. The alloy of claim 4, wherein said fluidizing agent comprises boron.

6. The alloy of claim 1, wherein said alloy further comprises a deoxidant.

7. The alloy of claim 6, wherein said deoxidant comprises silicon, phosphorus or boron.

8. The alloy of claim 1, wherein said alloy further comprises 5 to 8% by weight nickel, 0.1 to 1% silicon and 0.01 to 0.1% boron.

9. The alloy of claim 1, wherein said alloy comprises by weight 6 to 8% gold, 30 to 33% copper, 20 to 22% silver, 6 to 8% palladium, 24 to 26% zinc, 0.2 to 1% aluminum and 0.5 to 1.5% platinum.

10. The alloy of claim 9, wherein said alloy further comprises 5 to 7% by weight nickel, 0.1 to 0.3% silicon and 0.01 to 0.02% boron.

11. A gold-colored tarnish and corrosion-resistant alloy consisting essentially of by weight 5 to 11% gold, 28 to 35% copper, 19.5 to 22.5% silver, 6 to 11% palladium, 22 to 32% zinc, 0.1 to 1% aluminum, 0.5 to 3% platinum, 5 to 8% by weight nickel, 0.1 to 1% silicon and 0.01 to 0.1% boron.

12. An article of jewelry formed of the alloy of claim 1 or 11.

* * * * *

UNITED STATES PATENT AND TRADEMARK OFFICE

CERTIFICATE OF CORRECTION

PATENT NO. : 5,409,663

DATED : April 25, 1995

INVENTOR(S) : Arthur D. Taylor

It is certified that error appears in the above-indentified patent and that said Letters Patent is hereby corrected as shown below:

Col. 2, line 66, "7,000%" should be --7.000%--.

Col. 2, line 67, "25,482%" should be --25.482%--.

Col. 2, line 67, "21,700%" should be --21.700%--.

Col. 3, line 3, "1,000%" should be --1.000%--.

UNITED STATES PATENT AND TRADEMARK OFFICE

CERTIFICATE OF CORRECTION

PATENT NO. : 5,409,663
DATED : April 25, 1995
INVENTOR(S) : Arthur D. Taylor

It is certified that error appears in the above-indentified patent and that said Letters Patent is hereby corrected as shown below:

Col. 3, please make the following underline and spacing changes to the table as indicated below:

| | | | |
|---|---|---|---|
| Color | Light Yellow | Light Yellow | Yellow |
| Perspiration Resistance | Slight Darkening; White Deposit | Moderate Darkening; White Deposit | Slight Darkening |

UNITED STATES PATENT AND TRADEMARK OFFICE

CERTIFICATE OF CORRECTION

PATENT NO. : 5,409,663

DATED : April 25, 1995

INVENTOR(S) : Arthur D. Taylor

It is certified that error appears in the above-indentified patent and that said Letters Patent is hereby corrected as shown below:

cont.

| | | | |
|---|---|---|---|
| **Hydrogen Sulfide** | **Blackening Considerable** | **Blackening Considerable** | **Blackening Slight** |
| **Humidity** | | | |
| **7 Days** | **No Effect** | **No Effect** | **No Effect** |
| **14 Days** | **No Effect** | **Slight Darkening** | **Slight Darkening** |
| **21 Days** | **No Change** | **No Change** | **No Change** |

Signed and Sealed this

Twenty-eighth Day of May, 1996

*Attest:*

*Attesting Officer*

Bruce Lehman

BRUCE LEHMAN

*Commissioner of Patents and Trademarks*